US006000368A

United States Patent [19]

Mikame

[11] Patent Number: 6,000,368

[45] Date of Patent: Dec. 14, 1999

[54] THREE-DIMENSIONAL CAMSHAFT AND ITS MANUFACTURING METHOD

[75] Inventor: Kazuhisa Mikame, Nagoya, Japan

[73] Assignee: Toyota Jidosha Kabushiki Kaisha, Toyota, Japan

[21] Appl. No.: 09/118,984

[22] Filed: Jul. 17, 1998

[30] Foreign Application Priority Data

Jul. 18, 1997 [JP] Japan ..... 9-193686

[51] Int. Cl.[6] ..... F01L 1/34; F01L 13/00

[52] U.S. Cl. ..... 123/90.18; 123/90.6; 74/567; 74/568 R

[58] Field of Search ..... 123/90.18, 90.6; 74/567, 568 R

[56] References Cited

U.S. PATENT DOCUMENTS

| | | | |
|---|---|---|---|
| 2,069,587 | 2/1937 | Mattern | 123/90.18 |
| 3,023,870 | 3/1962 | Udelman | 123/90.18 |
| 4,401,069 | 8/1983 | Foley | 123/90.18 |
| 4,597,365 | 7/1986 | Madaffer | 123/90.6 |
| 4,977,793 | 12/1990 | Husted | 123/90.6 |
| 5,080,055 | 1/1992 | Komatsu et al. | 123/90.11 |
| 5,085,099 | 2/1992 | Hughes | 123/90.6 |
| 5,307,708 | 5/1994 | Matt | 123/90.6 |
| 5,419,217 | 5/1995 | Umezawa et al. | 123/90.6 |

FOREIGN PATENT DOCUMENTS

| | | | |
|---|---|---|---|
| 0159811 | 10/1985 | European Pat. Off. . | |
| 0462081 | 12/1991 | European Pat. Off. . | |
| 330010 | 3/1903 | France . | |
| 60-9803A | 1/1985 | Japan . | |
| 60-44659A | 3/1985 | Japan . | |
| 3179116A | 8/1991 | Japan . | |
| 808675 | 2/1981 | U.S.S.R. | 123/90.18 |

OTHER PUBLICATIONS

Patent Abstracts of Japan, vol. 004, No. 123 (M–029), Aug. 30, 1980 & JP 55 081212 A (Nissan Motor Co., LTD.).

*Primary Examiner*—Weilun Lo
*Attorney, Agent, or Firm*—Kenyon & Kenyon

[57] ABSTRACT

A camshaft assembly has a shaft and a cam that are formed independently and then assembled together. The cam includes an inclined section and a parallel section. The radius of the inclined section varies in the axial direction in at least one angular section of the cam, and the cross section of the parallel section is constant in the axial direction. The parallel section is adjacent to the inclined section and not contacted by the cam follower.

4 Claims, 8 Drawing Sheets

THREE-DIMENSIONAL CAMSHAFT AND ITS MANUFACTURING METHOD

BACKGROUND OF THE INVENTION

The present invention relates to an assembled camshaft. More specifically, the present invention pertains to a three-dimensional camshaft having a three-dimensional cam and its manufacturing method. The cam profile of the three-dimensional cam varies axially.

As generally known, for example, in a valve train of an on-vehicle internal combustion engine, an intake or an exhaust valve is selectively opened and closed by the rotation of a camshaft driven by an output shaft, or crankshaft. In recent years, a so-called three-dimensional camshaft has been proposed. The three-dimensional camshaft has a three-dimensional cam. The radius of the cam face changes in the axial direction of a camshaft, so that performance characteristics such as engine power and fuel consumption rate are optimized in accordance with engine operation conditions (Refer to Japanese Unexamined Patent Publication No. 3-179116). The camshaft varies valve characteristics such as intake valve opening time and exhaust valve closing time.

To change the valve characteristics, the camshaft is hydraulically moved in the axial direction. This changes the cam profile at the position where a follower, or valve lifter contacts the cam.

As shown in FIG. 9(*a*) to (*c*), a nose 53 of a three-dimensional cam 52 changes continuously along its axis. Accordingly, the cam 52 varies the valve characteristics in accordance with the position where the valve lifter contacts the cam.

Generally, a camshaft is manufactured as an assembled unit. In other words, the cam generally described above is attached to a shaft, which is generally cylindrical or columnar and is made of steel. It is necessary to accurately control valve open-close motion in synchronization with piston up-down motion in the engine. Accordingly, when a camshaft is manufactured, high precision is required with regard to the cam assembly angle, or angular position of each cam about the axis of the shaft (called cam assembly phase hereafter).

For example, Japanese Unexamined Patent Publication No. 60-9803 describes a method to determine the cam assembly phase with high precision by the use of a hollow pin. In this method, apertures corresponding to each proper assembly phase are formed both on a cam and a shaft. The cam assembly phase is determined by inserting the hollow pin in the apertures.

Also, for example, Japanese Unexamined Patent Publication No. 60-44659 describes a method for determining the cam assembly phase by engaging a key with a keyway. In this method, the shaft has a keyway on its periphery, and the cam has a key on the inner surface of a shaft insertion hole. The engagement of the key with keyway determines the cam assembly phase. However, it is necessary to form apertures and keyways with high precision in either method. As a result, the camshaft manufacturing cost is high.

On the other hand, when using a usual flat nosed cam (a cam having a constant cam-nose radius), a jig having a generally V-shaped recess is used to adjust the cam assembly phase. As shown in FIG. 10(*a*) and (*b*), a shaft (not shown), which has been rotated to a certain angular position, is inserted into a hole 56 of a cam 55, with the nose of the cam 55 fixed in the V-shaped recess of the jig 54. Then, the cam 55 is fixed with respect to the shaft member by a coupling method such as shrink fit. In this case, the cam 55 and the jig 54 make line contact with each other, and the cam 55 is securely held by the jig 54. According to this method, the cam assembly phase is determined easily and precisely without machining the cam 55 or the shaft member in any special way.

However, when the method using the jig 54 is applied to manufacturing a three-dimensional camshaft, the following problems arise. As shown in FIG. 11(*a*), (*b*), in three-dimensional camshafts, the nose 53 of a cam 52 is inclined with respect to the axis of the camshaft. The edge of the cam 52 thus makes point contact with the jig 54, and the cam 52 is not securely fixed. This also makes it impossible to precisely position the cam 52 on the shaft. Since there is point contact between the edge of the cam 52 and the surface of the jig 54, the jig 54 and the edge of the cam 52 are frequently damaged.

To control the precision of the cam profile, the cam profile shape is measured. However, in three-dimensional camshafts, it is quite difficult to measure the cam profile, and the cam profile is not as precise. This is because the nose surface is inclined with respect to the shaft axis, and the measured cam profile shape varies axially.

SUMMARY OF THE INVENTION

The objective of the present invention is to provide a three-dimensional camshaft and its manufacturing method, wherein a three-dimensional cam is easily and precisely fixed to a shaft.

To achieve the above objective, the present invention provides a camshaft assembly having a shaft and a cam that are formed independently and then assembled together. The cam includes an inclined section and a parallel section. The radius of the inclined section varies in the axial direction in at least one angular section of the cam, and the cross section of the parallel section is constant in the axial direction. The parallel section is adjacent to the inclined section.

The present invention further provides a method of forming a camshaft having a shaft and a cam assembled to the shaft includes a step of providing a cam having an inclined section and a parallel section. The radius of the inclined section varies in the axial direction in at least an angular section of the cam, and the radius of the parallel section is constant in the axial direction. The parallel section has a maximum radius that is the same as the maximum radius of the inclined section. The next step is holding the parallel section of the cam between walls of generally V-shaped grooves of a jig so that the position of the cam with respect to the jig is fixed. The parallel section and the walls make line contact with one another. The next step is installing the cam on the shaft by moving the cam and the shaft with respect to each other and by inserting the shaft through a hole formed axially in the cam.

The present invention provides a method of forming a camshaft having a shaft member and a cain assembled to the shaft member includes a step of positioning, on a support, a cam with an inclined section and a parallel section. The radius of the inclined section varies in the axial direction in at least an angular section of the cam, and the radius of the parallel section is constant in the axial direction of the cam. The maximum radius of the parallel section is the maximum radius of the inclined section. The next step is holding the cam in a fixed position with clamp members engaging the cam. The next step is assembling the cam to the shaft member by moving the shaft axially with respect to the cam and thus inserting the shaft in a hole formed axially in the cam.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which:

FIG. 1(*b*) is a sectional view taken on the line 1*b*—1*b* of FIG. 1(*a*);

FIG. 3(*b*) is a sectional view taken on the line 3*b*—3*b* of FIG. 3(*a*);

FIG. 4(*b*) is a partial cross sectional view showing a three-dimensional cam manufacturing apparatus;

FIG. 9(*b*) is a plan view showing the cam of FIG. 9(*a*);

FIG. 9(*c*) is a perspective view showing the cam of FIGS. 9(*a*), (*b*);

FIG. 10(*b*) is a side elevational view of FIG. 10(*a*);

FIG. 11(*b*) is a side elevational view of FIG. 11(*a*).

DETAILED DESCRIPTION OF THE PREFERRED EMBODIMENTS

Figure 1:
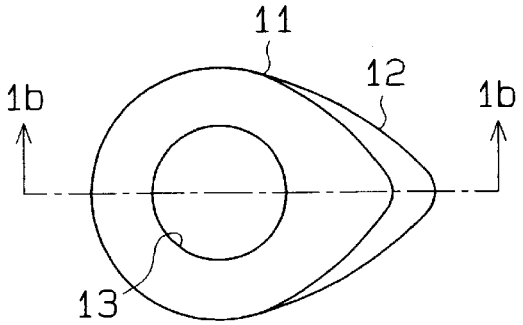
FIG. 1(*a*) is a plan view of a cam employed in a three-dimensional camshaft according to the present invention.
Figure 1:
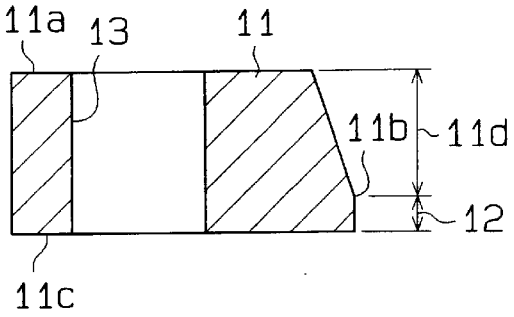
Figure 2:
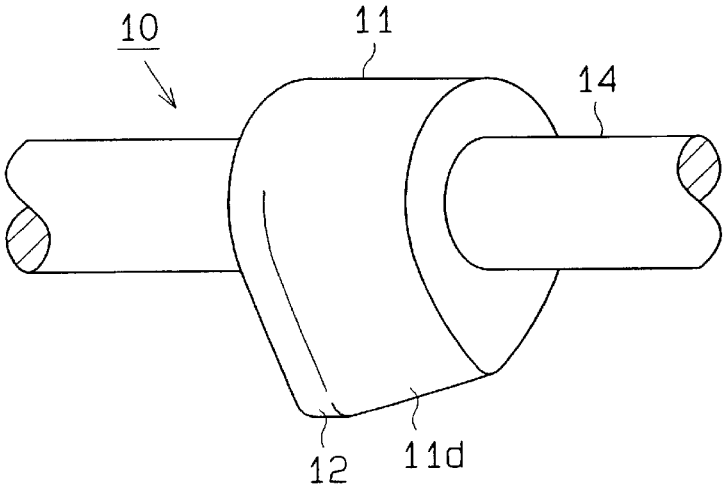
FIG. 2 is a partial perspective view showing a three-dimensional camshaft assembly.

A three-dimensional camshaft according to the present invention will now be described in reference to FIG. 1(*a*), (*b*) and FIG. 2. A cam 11 has a hole 13 for inserting a shaft member 14. A three-dimensional camshaft 10 is manufactured by inserting the shaft member 14 through the hole 13 and fixing it.

Concerning the profile of the cam 11, the cam's base circle is the same from a top surface 11*a* to a bottom surface 11*c*, and the radius of the cam nose varies axially. More specifically, the radius of the cam nose continuously increases from the top surface 11*a* to a corner position 11*b* (over an inclined section 11*d*), and the radius of the cam nose is constant from the corner position 11*b* to the bottom surface 11*c* (over a parallel section 12). Accordingly, the cam nose does not change in the parallel section 12. The parallel section 12 has a uniform oval cross section and extends parallel to the axis of the hole 13. In short, the cam surface of the cam 11 includes both the inclined section 11*d* and the parallel section 12. The parallel section 12 has the same radius as the maximum radius of the inclined section 11*d*, and is joined to the inclined section 11*d* at the maximum radius point of the inclined section 11*d*. Further, the cam 11 is manufactured using molded powder metallurgy and cold forging. The cam profile of the cam 11 including the parallel section is finished with high precision.

Figure 3A:
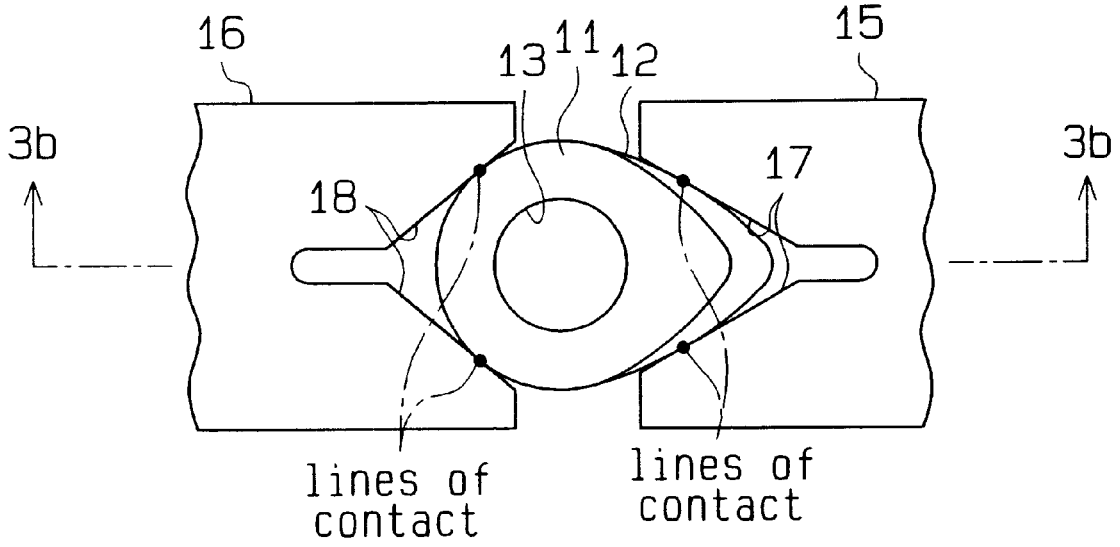
FIG. 3(*a*) is a plan view showing a jig for determining a cam assembly phase of a three-dimensional camshaft assembly.
Figure 3B:
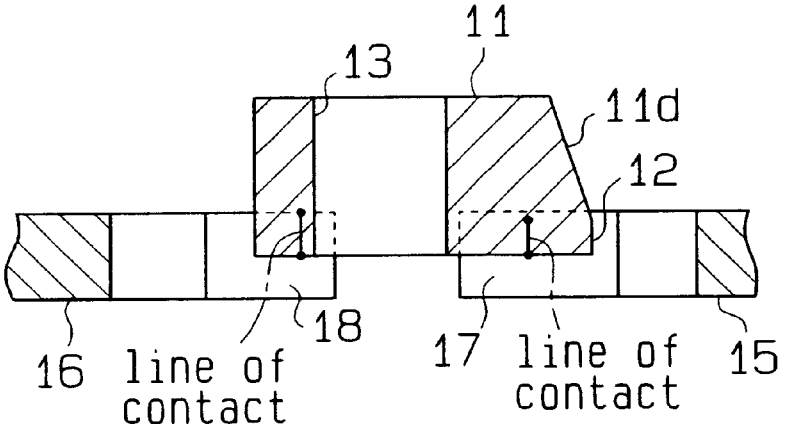

When fixing the cam 11 on the shaft 14, as shown in FIGS. 3(*a*) and (*b*), the cam 11 is held by two jigs 15, 16. The jigs 15, 16 include generally V-shaped grooves 17, 18. The walls of the V-shaped grooves are parallel to the axis of the fixed cam 11.

Accordingly, the cam 11 and the jigs 15, 16 make line contact with each other. The cam 11 is engaged at the parallel section both on the nose and on the side opposite to the nose by the jigs 15, 16. This securely holds the three-dimensional cam and determines the cam assembly phase easily and precisely. Also, damage to the edge of the cam 11 and to the jigs 15, 16 is avoided.

Figure 4A:
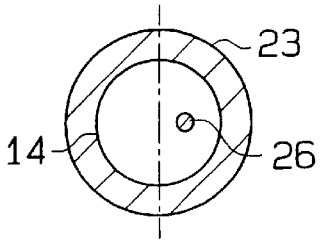
FIG. 4(*a*) is a sectional view showing a camshaft.
Figure 4B:
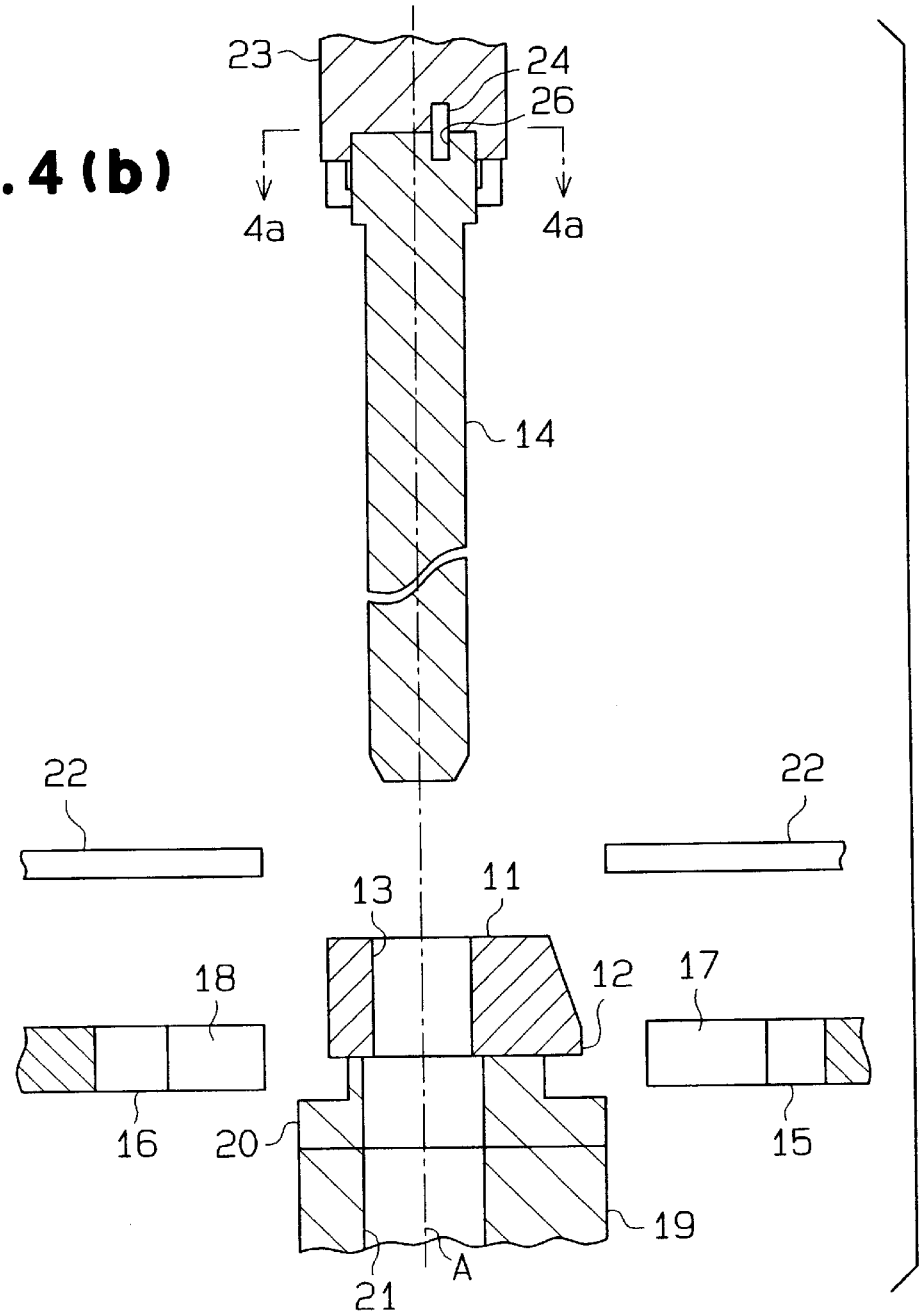

A method and apparatus for attaching the three-dimensional cam 11 to the shaft 14 using the jigs 15, 16 will now be described. As shown in FIG. 4(*b*), a cam support 20 having an axial projection is provided on a base 19, and the cam 11 is arranged on the upper surface of the cam support 20. The cam support 20 is located at a predetermined reference position. The base 19 and the cam support 20 extend vertically and have a hole 21 that has a radius greater than that of the shaft. The hole 21 serves to accommodate the shaft 14 when the shaft 14 is inserted in the hole 13 of the cam 11.

When the cam 11 is arranged on the support 20, the jigs 15, 16 are movably arranged at the height where the parallel section of the cam 11 is positioned. Horizontal and vertical movement of the jigs 15, 16 is controlled by an actuator (not shown) such as an electric, hydraulic, or air pressure type actuator.

A pair of clamps 22 are arranged above the base 19. The clamps 22 restrain the vertical movement of the cam 11 by pressing down on the cam 11. Like the jigs 15, 16, horizontal and vertical move of the clamps 22 is controlled by an actuator (not shown).

The shaft 14 is held by a chuck 23 to determine the vertical position of the shaft 14. A pin 24 of the chuck 23 is inserted in a hole 24 (FIG. 4(*a*)) formed on the end surface of the shaft 14. This restrains rotation of the shaft member 14 about the axis "A" with respect to the chuck 23. The position of the chuck 23 is accurately controlled both in the axial and angular, or rotational, directions by a numerical control apparatus (not shown), with the axis "A" of the shaft member 14 kept vertical.

The manufacturing steps of the three-dimensional camshaft using the above apparatus will now be described in reference to FIGS. 4(*a*) to 8. First, the shaft 14 is gripped by the chuck 23. The chuck 23 is accurately positioned by the numerical controller using parameters such as the distance from the cam support 20, the position of the axis of the holes 13, 21, and the angle of the pin 24 about the axis "A".

The cam 11 is heated in a heating furnace (not shown) such as an electric furnace or high-frequency heating furnace until it reaches a predetermined temperature. This thermally expands the hole 13 of the cam 11 enough to allow the insertion of the shaft 14. The heated cam 11 is placed on the cam support 20 as shown in FIG. 4(*b*).

Figure 5:
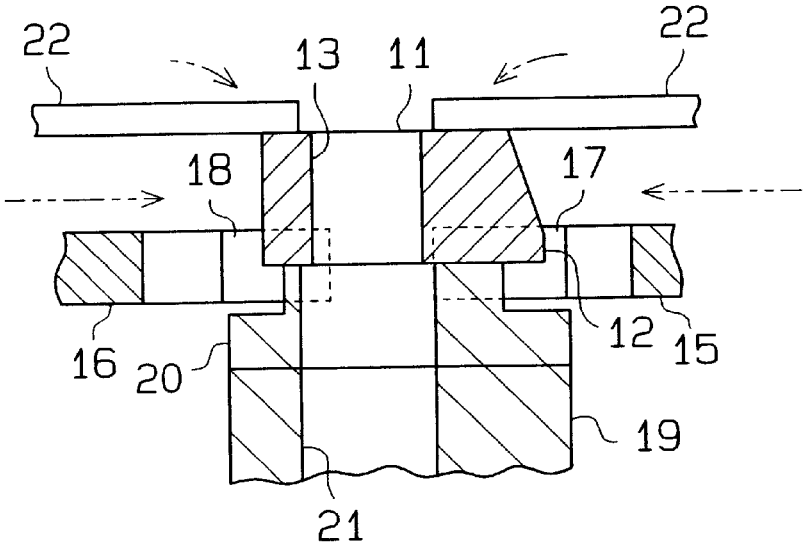
FIGS. 5 to 8(*a*) and 8(*b*) are cross sectional views showing steps for assembling the three-dimensional camshaft.

Then, the jigs 15, 16 grips the cam 11. As shown in FIG. 5, the parallel section 12 of the cam 11 contacts the V grooves of the jigs 15, 16. This prevents the cam 11 from moving horizontally or rotating about the axis "A".

Subsequently, the clamps 22 are horizontally and vertically moved so that the lower surfaces of the clamps 22 contact the upper surface of the cam 11. This restrains the vertical movement of the cam 11. Through the above steps, the shaft 14 and the hole 13 share the same axis "A", and the cam 11 is fixed at a predetermined position.

Figure 6:
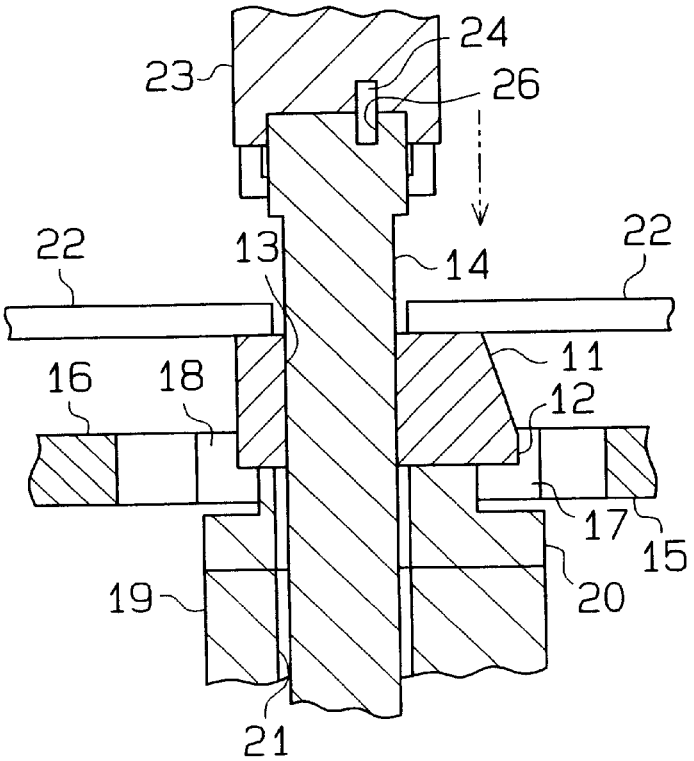

After the cam position is fixed, the numerical controller moves the chuck 23 and the shaft 14 vertically downward. The controller then inserts the shaft 14 through the hole 13, as shown in FIG. 6. The insertion of the shaft 14 is smooth because the radius of the hole 13 is expanded by thermal expansion. After a first cam is fixed at a predetermined phase, or position, the shaft 14 and the cam 11 are not disturbed until the temperature of the cam 11 falls below a predetermined level. The temperature decline reduces the radius of the hole 13, and the shaft 14 and the cam 11 are integrally and rigidly fixed to each other by a so-called shrink fit.

Figure 7:
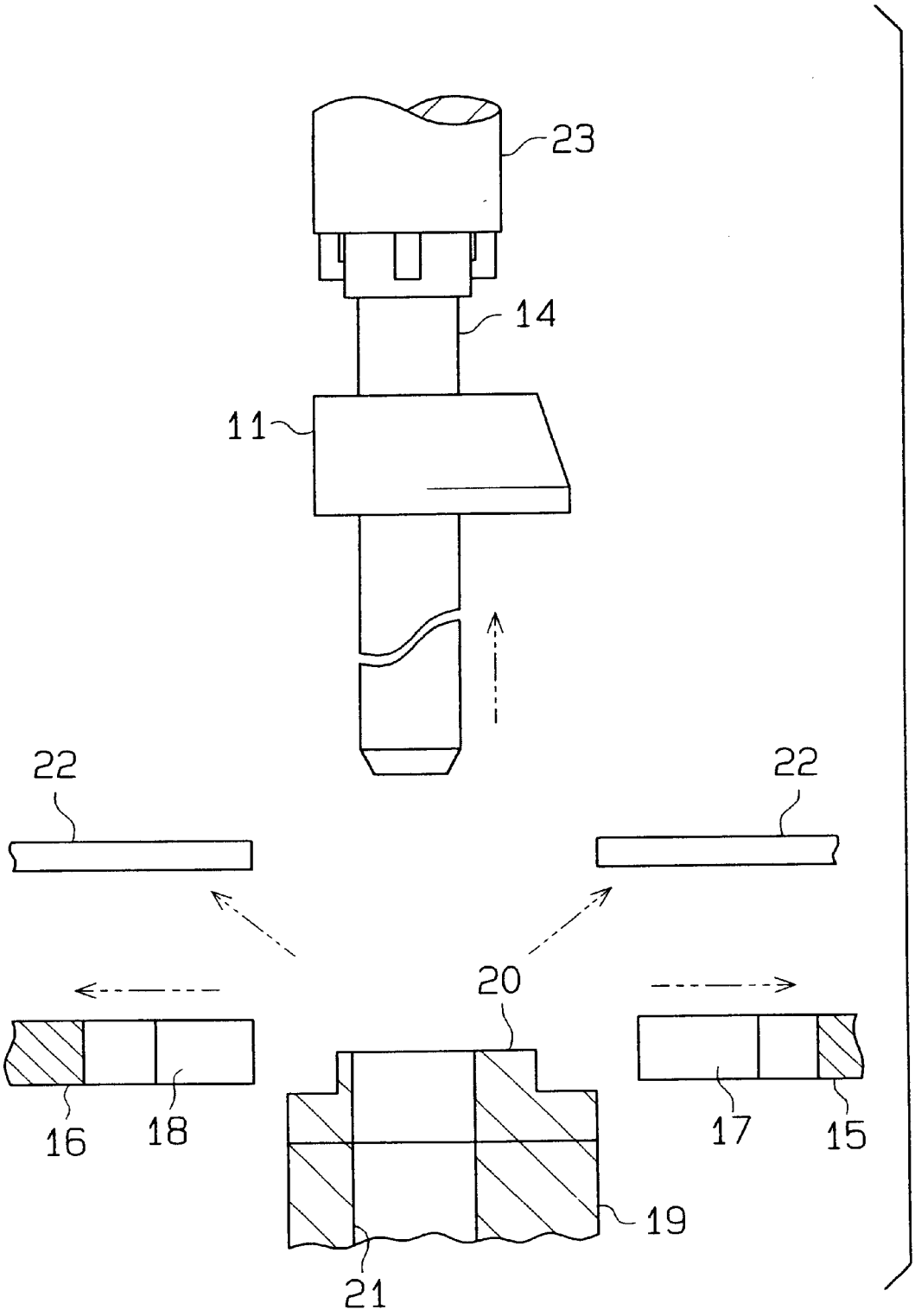

After the shrink fit is complete, as shown in FIG. 7, the cam 11 is released by moving the jigs 15, 16 and clamps 22 away from the cam 11. Then, the numerical controller moves the chuck 23, which carries the shaft 14, vertically upward. Since the cam 11 is fixed to the shaft 14, the cam 11 is moved vertically upward with the shaft member 14.

Figure 8A:
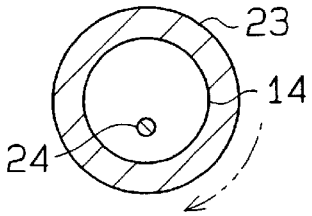
Figure 8B:
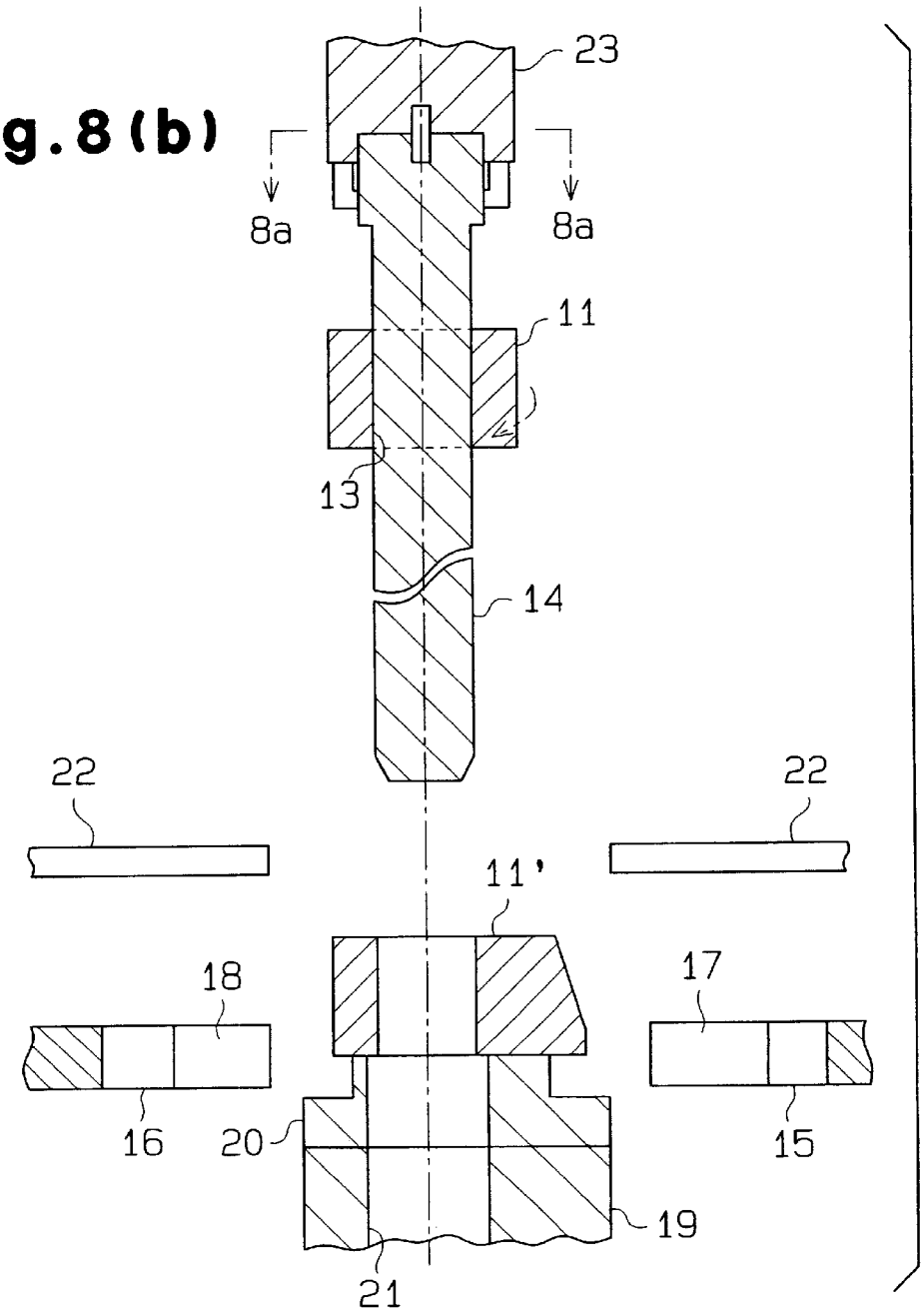
Figure 9A:
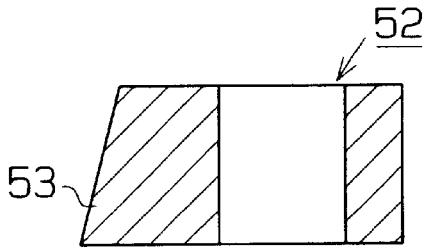
Fig.9(a)(Prior Art)
FIG. 9(*a*) is a sectional view showing a cam of a prior art three-dimensional camshaft.
Figure 9B:
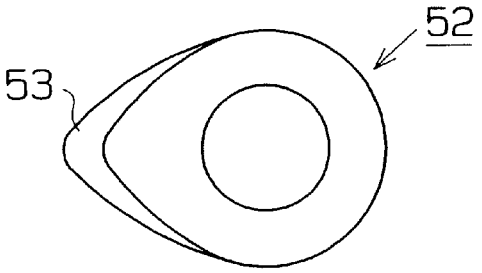
Fig.9(b)(Prior Art)
Figure 9C:
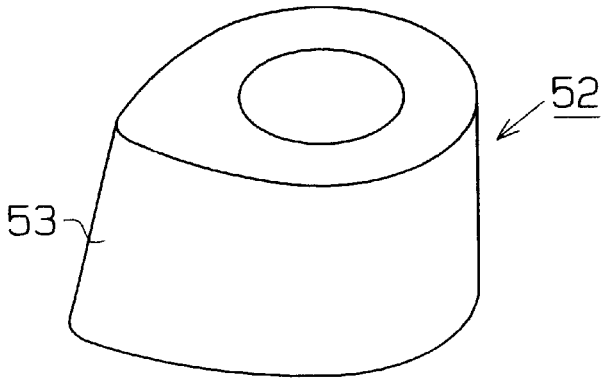
Fig.9(c)(Prior Art)
Figure 10A:
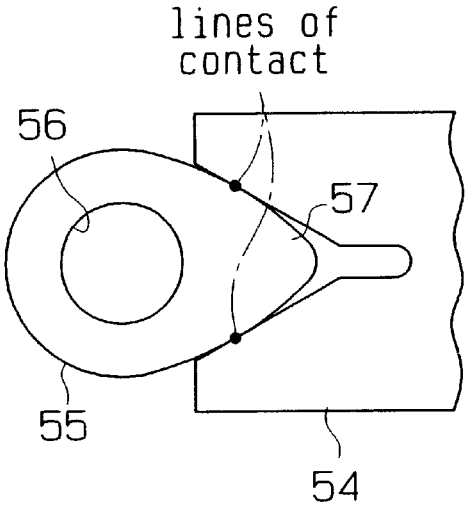
Fig.10(a) (Prior Art)
FIG. 10(*a*) is a plan view showing a prior art jig for determining the cam assembly phase.
Figure 10B:
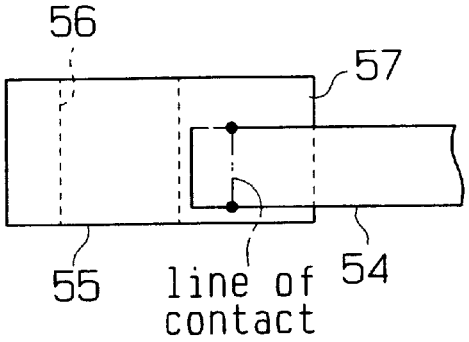
Fig.10(b) (Prior Art)
Figure 11A:
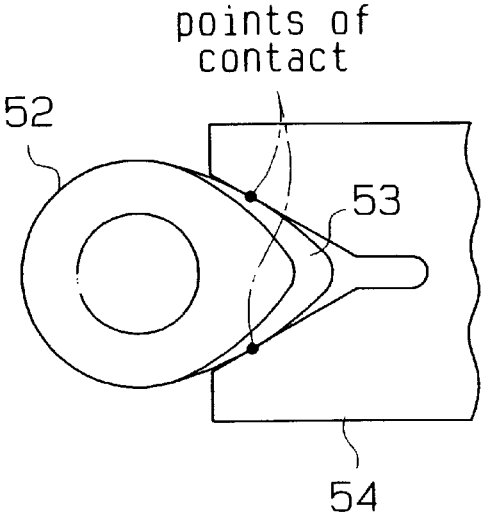
Fig.11(a) (Prior Art)
FIG. 11(*a*) is a plan view showing a prior art jig for determining the cam assembly phase.
Figure 11B:
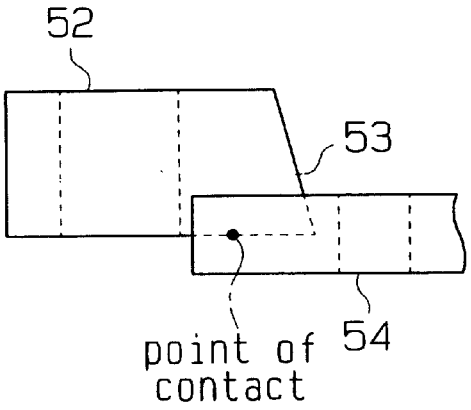
Fig.11(b) (Prior Art)

As described above, the installation of one cam 11 is finished. Then, as shown in FIG. 8(*a*), (*b*), another cam 11' is fixed to the shaft 14 in a similar manner. In detail, after a heated cam 11 is held on the support 20, the numerical controller rotates the shaft 14 by a predetermined angle corresponding to the proper phase angle of the cam 11'. The camshaft assembly is employed in four cylinder engines. When four cams 11 are installed at equal phase angle intervals, the shaft 14 is rotated 90 degrees between installations. Then, the precisely positioned shaft 14 is moved vertically downward and held until the second cam 11 is shrink fitted on the shaft 14. The above steps are repeated according to the number of the cams to be installed on the shaft 14 to complete a three-dimensional camshaft 10 assembly.

The completed camshaft 10 is installed in the engine to drive the intake and exhaust valves. The engine valves are driven by the rotation of the camshaft 10. When the camshaft 10 is rotated, the parallel sections 12 of each cam 11 do not touch the corresponding valve lifters. Only the inclined sections 11*d* of each cam 11 contact the valve lifter.

The advantages of the present invention are as follows.

When attaching the three-dimensional cam 11 to the shaft 14, the walls of the V-grooves 17, 18 of the jigs 15, 16 and the parallel section 12 of the cam 11 make line contact, so that the phase (angular position) of the cam 11 is easily and precisely fixed. This improves the productivity and quality of the three-dimensional camshaft 10. Also, the damage to the edge of the cam 11 and the jig is avoided.

Further, the shape of the cam profile is measured at the parallel section 12, and this makes control of the cam profile precision easier.

Since the shape of the cam 11 of the present embodiment can be obtained by making small changes to the shape of a conventional three-dimensional cam 52, existing production facilities can be used to produce the camshaft 10.

It should be apparent to those skilled in the art that the present invention may be embodied in many other specific forms without departing from the spirit or scope of the invention. Particularly, it should be understood that the invention may be embodied in the following forms.

In the present embodiment, the present invention is embodied in the three-dimensional camshaft 10 having the cam 11, the cam nose radius of which changes varies axially. However, the present invention may be embodied in other types of three-dimensional camshafts.

In the above embodiment, when installing the cam 11, the cam 11 is fixed and the shaft 14 is moved. Instead, however, the shaft member may be fixed and the cam 11 may be moved by the numerical controller. Or, both the shaft member 14 and the cam 11 may be moved. The cam 11 and the shaft member 14 are not necessarily moved and positioned by numerical control. As long as high precision is ensured, the position control may be performed by, for example, a limit switch.

While the cams were described as being installed sequentially, a multi-cam jig can be constructed to permit simultaneous installation of all cams.

To fix the cam 11 on the shaft member 14, methods other than shrink fit, such as press fit may be employed.

Therefore, the present examples and embodiments are to be considered as illustrative and not restrictive and the invention is not to be limited to the details given herein, but may be modified within the scope and equivalence of the appended claims.

What is claimed is:

1. A camshaft assembly having a shaft and a cam that are formed independently and then assembled together, the cam comprising:

an inclined section, wherein the radius of the inclined section varies in the axial direction in at least one angular section of the cam and in contact with a cam follower; and a parallel section, wherein the cross section of the parallel section is constant in the axial direction, adjacent to the inclined section and not contacted by the cam follower.

2. The camshaft according to claim 1, wherein the parallel section has a uniform oval cross section.

3. The camshaft according to claim 2, wherein the cam is fixed at a predetermined angle with respect to the shaft, and the parallel section is used to contact a jig for determining the position of the cam during assembly.

4. The camshaft according to claim 1, wherein the parallel section joins the inclined section at a location where the radius of the inclined section is maximum.

* * * * *